US006357720B1

(12) United States Patent
Shapiro et al.

(10) Patent No.: US 6,357,720 B1
(45) Date of Patent: Mar. 19, 2002

(54) CLEAR ICE TRAY

(75) Inventors: Andrew Philip Shapiro; Jerome Johnson Tiemann, both of Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,863

(22) Filed: Jun. 19, 2001

(51) Int. Cl.[7] ..... F25C 1/24

(52) U.S. Cl. ..... 249/119; 62/66; 425/261; 426/66

(58) Field of Search ..... 249/119; 425/261; 426/66; 62/66, 85

(56) References Cited

U.S. PATENT DOCUMENTS 3,775,992 A * 12/1973 Bright ..... 62/73
3,864,933 A * 2/1975 Bright ..... 62/137
3,892,105 A * 7/1975 Bernard ..... 62/353
3,952,539 A 4/1976 Hanson et al.
4,852,359 A * 8/1989 Mazzotti ..... 62/68
5,364,063 A * 11/1994 Nishimura et al. ..... 249/52
5,676,875 A * 10/1997 Kelley ..... 249/117

OTHER PUBLICATIONS

Parker, "Understanding Commercial Ice Makers," 1988, pp: 29, 47.

* cited by examiner

*Primary Examiner*—James P. Mackey
(74) *Attorney, Agent, or Firm*—Patrick K. Patnode; Christian G. Cabou

(57) ABSTRACT

An ice tray includes mold cells each having an open top and closed bottom. The bottom is air permeable for venting released air during formation of ice cubes therein. And, external sides of the ice tray may be thermally insulated for enhancing directional solidification of the ice cubes.

28 Claims, 3 Drawing Sheets

Fig. 1
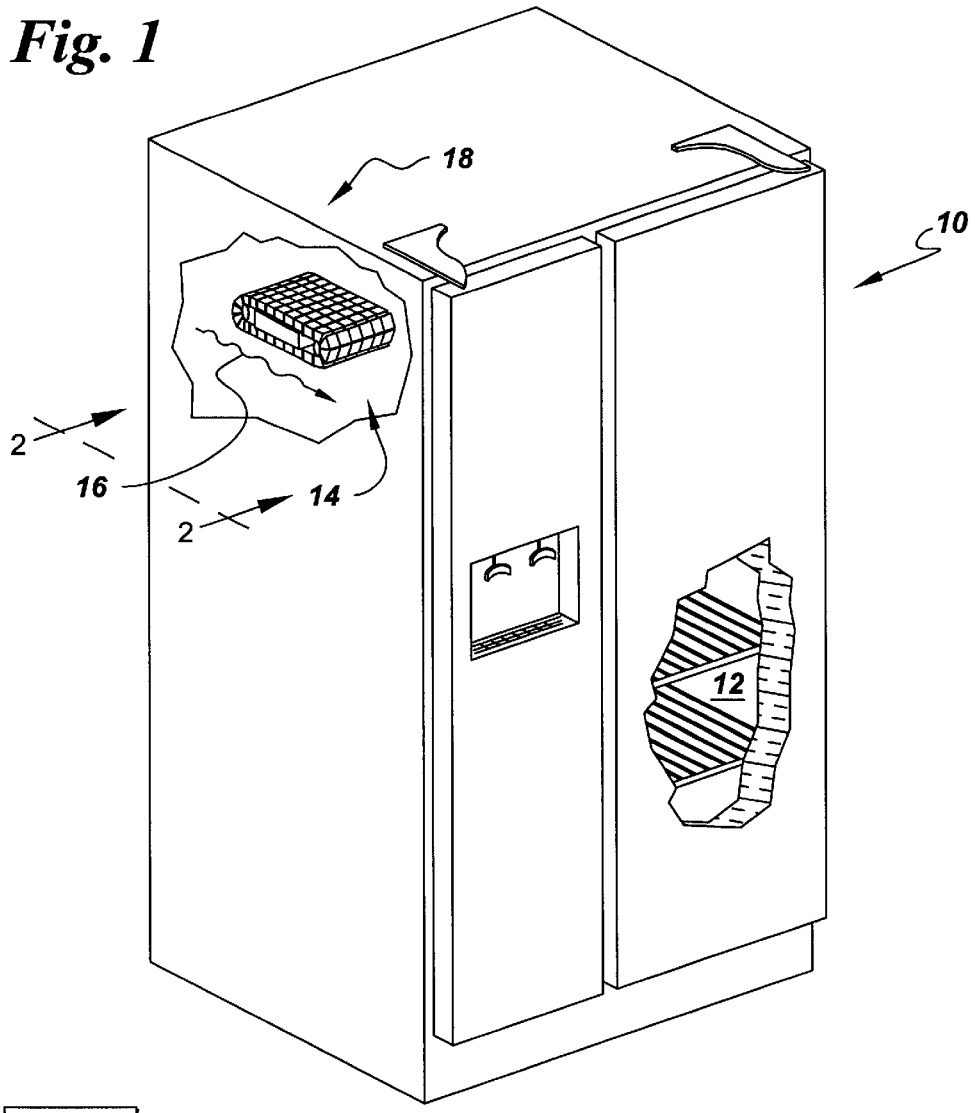
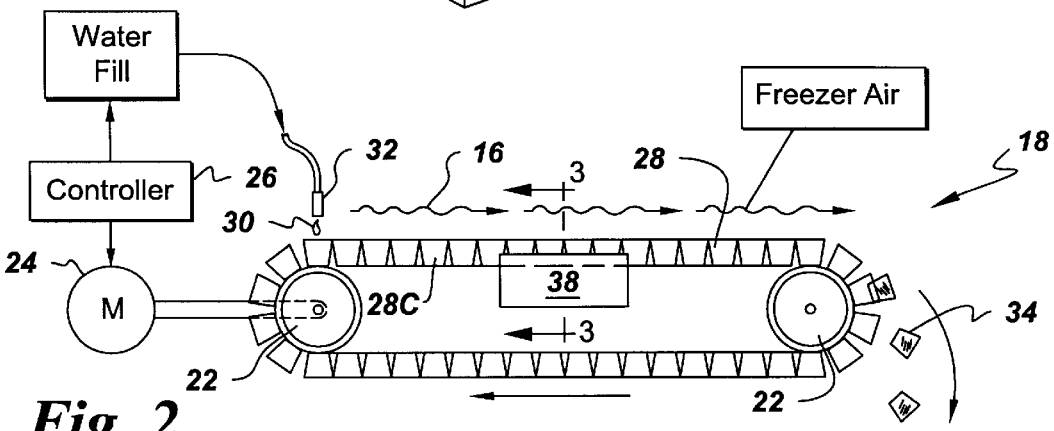
Fig. 2

CLEAR ICE TRAY

BACKGROUND OF INVENTION

The present invention relates generally to residential refrigerators, and, more specifically, to ice making therein.

A typical residential refrigerator includes a refrigeration compartment and a separate freezer compartment. Ice may be formed manually or automatically in the freezer in various conventional manners.

A simple plastic ice tray may be manually filled with water by the user and placed in the freezer for a sufficient time to freeze the water therein and form ice cubes. Alternatively, an automatic ice maker automatically fills an ice tray with water, and after freezing thereof automatically ejects the cubes from the tray into a storage hopper.

The air in the freezer compartment is typically well below freezing temperature and typically is circulated around all the exposed sides of the ice tray for maximizing the freezing rate thereof, as well as maximizing ice production rate in the automatic ice maker. However, the individual ice cubes freeze from outside in and thusly trap liberated air released from solution during the freezing process. The liberated air in the form of minute air bubbles is captured within the frozen cube and creates a cloudy or opaque appearance.

Accordingly, it is desired to provide an improved ice tray for making clear ice cubes in a residential refrigerator.

SUMMARY OF INVENTION

An ice tray includes mold cells each having an open top and closed bottom. The bottom is air permeable for venting released air during formation of ice cubes therein. And, external sides of the ice tray may be thermally insulated for enhancing directional solidification of the ice cubes

BRIEF DESCRIPTION OF DRAWINGS

The invention, in accordance with preferred and exemplary embodiments, together with further objects and advantages thereof, is more particularly described in the following detailed description taken in conjunction with the accompanying drawings in which:

FIG. 1 is an isometric view of an exemplary residential refrigerator having a freezer compartment including an ice tray in accordance with an exemplary embodiment of the present invention.

FIG. 2 is a side elevational view of the ice tray illustrated in FIG. 1 and taken along line 2—2, schematically illustrating a preferred method of making clear ice.

DETAILED DESCRIPTION

Figure 3:
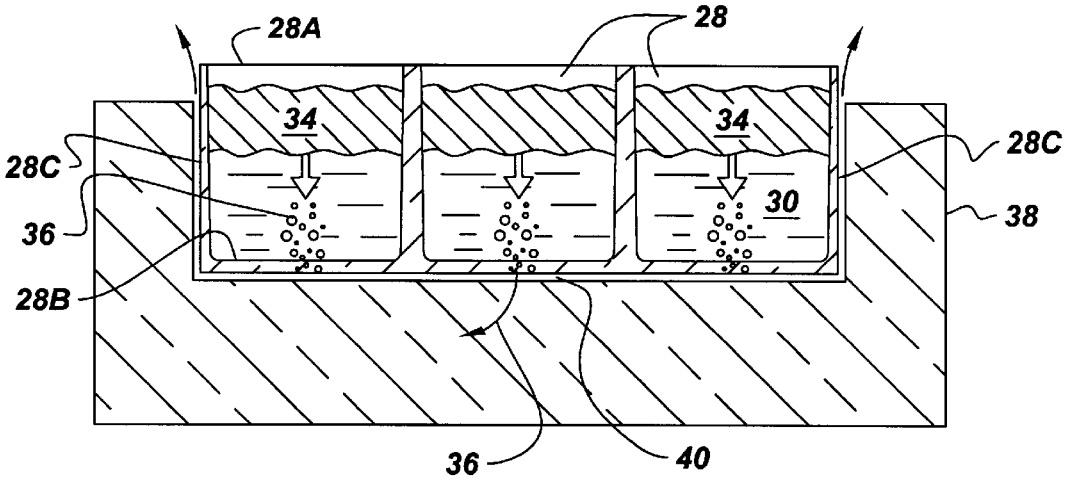
FIG. 3 is a sectional elevational view through a portion of the ice tray illustrated in FIG. 2 and taken along line 3—3.

Illustrated in FIG. 1 is a residential refrigerator 10 in an exemplary form having a refrigeration compartment 12 on the right side behind one door, and a freezer compartment 14 on the left side behind another door. The refrigerator includes a refrigeration system of any conventional form including a compressor, evaporator, and condenser (not shown) effective for removing heat from inside the refrigeration and freezer compartments in a conventional manner. In particular, freezing or freezer air 16 is circulated inside the freezer compartment at a temperature substantially below the freezing temperature of water for freezing food articles placed therein and maintaining frozen food articles.

An automatic ice maker 18 is disposed at the top of the freezer compartment, and is illustrated schematically in more detail in FIG. 2. An ice tray 20 in the exemplary form of a continuous belt is mounted horizontally on a pair of rollers 22. One of the rollers is operatively joined to an electrical motor 24 configured for rotating the roller and in turn rotating the ice tray belt intermittently during operation for the production of ice. The motor is operatively joined to a suitable electrical controller 26 which may have any conventional analog or digital form, such as a digitally programmable microprocessor.

The ice tray includes a plurality of laterally adjoining mold cells 28 which are individually filled with water 30 from a water inlet nozzle 32 also operatively joined to the controller 26 suitably controlled for filling the individual cells on demand and as needed.

As shown in FIGS. 2 and 3 the mold cells 28 are arranged in a suitable rectangular array or grid for forming corresponding ice cubes 34 upon freezing of the water contained in the cells. As shown in FIG. 3, each cell 28 has an open top 28 *a* in which the water is received, and a closed bottom 28*b* which is formed continuously with the sidewalls of each cell for containing the water therein during use.

In accordance with a particular feature of the present invention, the cell bottoms 28*b* are relatively thin for being air permeable to vent the air 36 released from the water as it freezes in the cells. In a preferred embodiment, the cell bottoms are formed of silicone and are sized in thickness to be relatively thin in the exemplary range of 10–50 mils (0.25–1.3 mm) for effectively removing the minute air bubbles released from solution in the water as the water freezes.

As indicated above, trapped air bubbles in frozen water is the cause of the cloudy or opaque appearance thereof. By permitting the air bubbles to escape from the forming ice cubes without being trapped therein relatively clear or transparent ice cubes may be produced.

Another advantage of the silicone mold cells is the thermal insulating characteristic of the silicone material as opposed to metal mold cells which rapidly conduct heat. As shown in FIG. 3, the entire mold cells may be formed of the silicone material including the laterally opposite external sides 28*c* of the outboard cells extending vertically between the cell bottoms and tops. The outboard or external surfaces of the ice tray, including the bottom thereof, is typically exposed to the freezer air in conventional ice trays. And in conventional ice trays, the water freezes inwardly from all sides of each cell.

However, by forming the external sides 28*c* and the cell bottoms 28*b* of a non-thermally conducting material, such as the silicone for example, heat transfer from the water is substantially reduced therearound as compared with heat transfer at the top surface of the cell water directly exposed to the freezer air through the open tops of the cells. In this way, directional solidification of the ice from the top of the cells vertically downwardly to the bottoms thereof may be promoted so that as the released air 36 is formed from the freezing water, it may be displaced vertically downwardly to the bottom of each cell where it permeates the bottom wall and is released or vented from the individual cells.

Nevertheless, the individual silicone mold cells are water tight for containing the water therein without leakage, yet permit directional solidification of the ice downwardly to the cell bottoms through which the liberated air 36 is vented and not trapped within the formed ice cubes. The resulting ice cubes will be substantially clear in appearance for promoting the desirability of the residential refrigerator to purchasers thereof.

In order to enhance the directional solidification of the downwardly forming ice illustrated in FIG. 3, the ice tray preferably also includes a thermally insulating jacket 38 illustrated in side and sectional views in FIGS. 2 and 3. The jacket 38 preferably includes portions covering the opposite external sides 28*c* of the ice tray as well as the several cell bottoms 28*b* extending laterally therebetween.

The insulating jacket 38 may be formed of any suitable material, such as polystyrene foam insulation for example, to provide additional thermal insulation around the exposed sides and bottoms of the mold cells for further reducing heat transfer between the water and the freezer air contained in the freezer compartment.

In this way, the cell tops are directly exposed to the freezer air for first freezing the water exposed thereat, with the water then being directionally frozen downwardly to complete freezing at the cell bottoms 28*b*. And, the released air 36 is vented through the thin cell bottoms to prevent trapping within the ice cubes for creating the clear appearance thereof.

In order to dissipate the released air 36 which seeps through the cell bottoms 28*b*, an air vent 40 in the preferred form of a small gap of a few millimeters is provided between the cell bottoms 28*b* and the enclosing jacket 38 and follows the inner surface of the jacket in flow communication with the outside thereof. In this way, the liberated air from the ice cubes is discharged through the vent 40 to the surrounding atmosphere outside the insulating jacket 38.

In the exemplary embodiment illustrated in FIG. 2, the mold cells 28 are arranged in a continuous belt having flexibility due to the elastomeric nature of the silicone. The belt includes a horizontal upper leg having upright cells, and a horizontal and parallel lower leg having upside down or inverted cells. And, the two legs are joined at their opposite ends by two corresponding bends in which the cells therein are elastically distorted as they travel around the corresponding rollers 22, with the ice cubes 34 being ejected as the cells are turned upside down between the two legs.

As shown in FIG. 2 the water 30 fills the upright cells at the left end of the upper leg at the beginning of the ice making process, and are carried by the belt to the right as the rollers are driven by the motor. The ice cubes form as the cells travel to the right in FIG. 2, and are ejected as the cells make the turn around the right roller 22. The lower leg accordingly has inverted cells which are empty and are carried back to the beginning of the ice track for their re-use.

Accordingly, the insulating jacket 38 preferably laterally adjoins the opposite external sides 28*c* of the upper leg illustrated in FIGS. 2 and 3 for forming respective air venting gaps 40 therebetween. The jacket is suitably mounted in the freezer compartment at a stationary location and permits the rotating ice tray belt to continuously pass therethrough. In this way, additional thermal insulation may be provided for the moving belt by preferentially locating the stationary jacket as illustrated in FIG. 2.

As shown in FIG. 2, the jacket 38 is preferably spaced inwardly from both opposite ends of the upper leg, and is preferably positioned along the middle of the upper leg between the two end rollers 22. The jacket 38 may extend the full horizontal length of the upper leg within which either water or ice is contained in the vertical cells, but preferably terminates short or inwardly from both opposite ends of the belt. For example, the jacket may be positioned in the middle third of the upper belt with the left and right thirds of the belt being unprotected by the jacket and directly exposed to the freezer air 16 on all exposed sides thereof.

This configuration of the belt ice tray 28 and the preferentially positioned insulating jacket 38 may be used for maximizing the ice production rate notwithstanding the insulating effect of the tray and jacket themselves. As shown in FIG. 2, the mold cells 28 are suitably filled with the water 30 from the inlet nozzle 32 at the beginning or left end of the upper leg. Since the entire belt is disposed inside the freezer compartment, the freezing air 16 is readily circulated over the water in the individual cells, as well as around the exposed external surfaces of those cells.

As better illustrated in FIG. 3, the water 30 contained in the cells is directionally frozen downwardly from the cell tops 28*a* to the cell bottoms 28*b* due to the insulating characteristics of the mold cells themselves, as well as due to the insulating effect of the surrounding jacket 38. As the water freezes from the top downwardly, the liberated air 36 from the freezing water is vented or passed through the air permeable cell bottoms 28*b* to form clear ice in the individual cells.

As shown in FIG. 2, the controller 26 is used for activating the motor 24 to drive the belt roller 22 and in turn rotate the ice tray belt clockwise in FIG. 2 to eject the ice cubes 34 at the right end thereof. Rotation of the belt is suitably timed in sequence so that as the water filled cells reach the right end of the upper leg, the water is fully frozen therein.

By preferentially placing the insulating jacket 38 near the middle of the upper leg, the individual cells may be filled with water outside the jacket to the left thereof where the individual cells are not protected by the insulating effect of the jacket. In this way, the water in the cells may be initially chilled close to the freezing temperature of water, and then the cells may be transported inside the insulating jacket 38 for final freezing therein to form the clear ice. The belt may again be rotated to the right in FIG. 2 so that the frozen ice cubes are removed from the thermal insulating protection of the jacket 38 for further reducing the temperature of the cubes prior to being ejected from the cells.

In this way, the insulating jacket 38 need only be configured in size and location for locally insulating only those cells in which directional solidification of the forming ice is required.

In the exemplary embodiment illustrated in FIG. 3, the mold cells are formed of silicone for their elastic flexibility and in particular their air permeability for venting the released air from the forming ice cubes. Any other suitable material may be used to form the mold cells providing venting of the released air is permitted.

Figure 4:
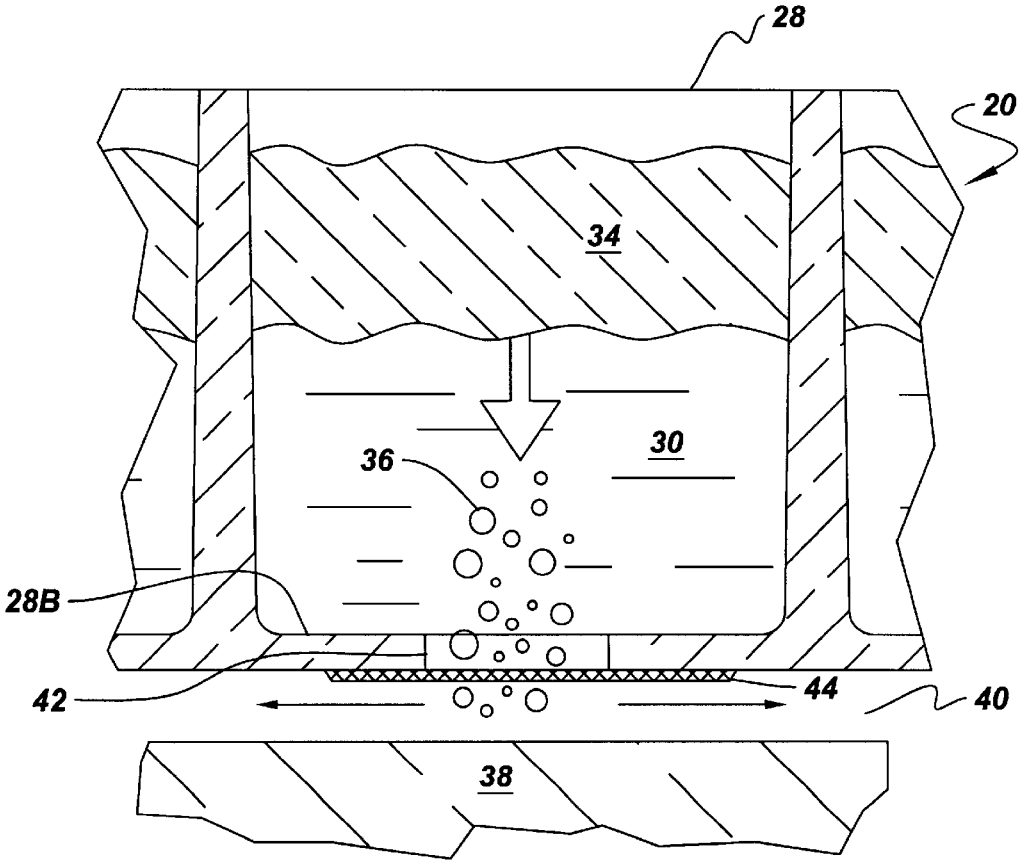
FIG. 4 is an enlarged view of one of the mold cells illustrated in FIG. 3 in accordance with another embodiment of the present invention.

For example, FIG. 4 illustrates an alternate embodiment of the belt ice tray 20 in which thicker silicone may be used to form the cells, with each cell bottom 28*b* having an aperture 42 extending vertically therethrough, with the aperture being in turn closed by an air permeable seal 44 preventing water leakage out the aperture. The seal 44 may be formed of a suitable fabric permeable to air but non-permeable to water leakage from the cells for containing the water therein. An exemplary fabric is sold under the trademark Gortex and is commercially available from W. L. Gore and Associates of Newark, Del.

Since directional solidification of the forming ice occurs downwardly in each cell, the cell bottom 28*b* must prevent water leakage therethrough, while still being permeable to air for release thereof to prevent entrapment in the ice causing cloudiness. The thin silicone cell bottom and the fabric sealed aperture are exemplary means for providing air permeability and venting of the released air through the bottom of each mold cell, yet prevent water leakage therefrom. Other forms of the cell bottom may be used having this capability.

In the exemplary embodiment illustrated in FIG. 3, the jacket 38 fully covers the bottom of the upper leg of the ice tray belt as well as the two exposed belt sides 28*c* for thermally insulating the bottom portions of the transverse row of cells in the belt. The jacket 38 may extend in elevation for the full height of the mold cells, or suitably shorter, as required to promote directional solidification downwardly in each cell. The generally U-shaped jacket 38 illustrated in FIG. 3 substantially reduces heat transfer from the bottom of the mold cells to ensure the preferred directional solidification.

Figure 5:
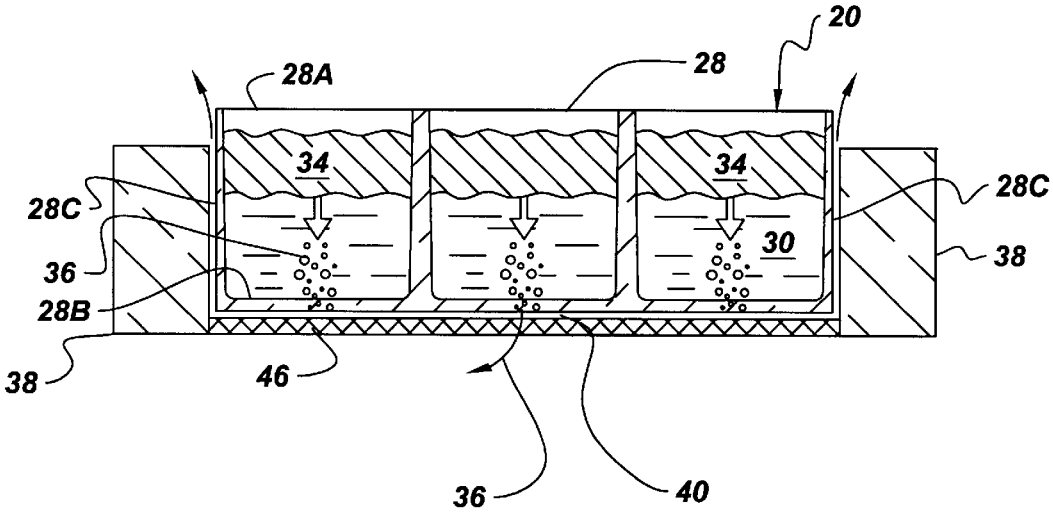
FIG. 5 is a sectional elevational view, like FIG. 3, of the ice tray in accordance with another embodiment of the present invention.

Illustrated in FIG. 5 is an alternate embodiment in which the insulating jacket 38 covers only the two opposite external sides 28*c* of the ice tray belt 20, without covering the undersides of the mold cells.

Instead, an electrical resistance heater 46 is disposed below the upper leg and the corresponding cell bottoms thereof for locally heating the cell bottoms to a temperature in the preferred range of about 28–34° F. for promoting directional solidification downwardly in each cell. The air vent gap 40 may then be defined between the heater and the bottom of the mold cells, and is continuous between the side jackets 38 covering the exposed sides of the belt. In this way, the freezing air removes heat from the top of the individual cells, with the exposed sides of the molds being insulated by the jackets 38, and the bottoms of the cells having a temperature controlled by the heater 46. A strong temperature gradient may then be formed from the top to the bottom of each cell for ensuring directional solidification downwardly in each cell, and the liberation of the air 36 which is passed through the cell bottoms in any of the manners disclosed above.

Figure 6:
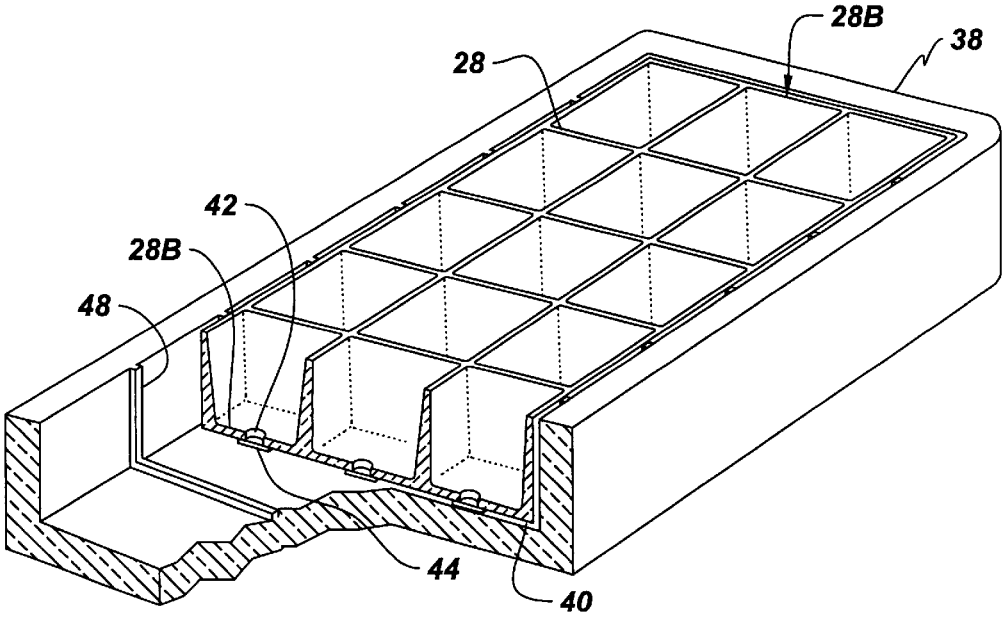
FIG. 6 is a partly sectional isometric view of an ice tray in accordance with another embodiment of the present invention.

Illustrated in FIG. 6 is yet another embodiment of the present invention in the form of a typical manual ice tray designated 20B. In this embodiment, the ice tray may be formed of a suitable elastomer material, such as silicone, in an exemplary rectangular grid of the several mold cells 28. The insulating jacket 38 completely covers the sides and the bottom of the tray grid and is suitably fixedly joined thereto using a suitable adhesive, such as silicone.

In this embodiment, a plurality of ribs 48 may be formed in the inner surface of the jacket 38 to suspend therein the ice tray grid to form the air venting gap 40 therebetween for discharge of the released air during the directional solidification of the ice. In the exemplary embodiment illustrated in FIG. 6, the aperture 42 and fabric seals 44 are used for venting the air through the bottoms of the cells, but the cell bottoms may be any form of the air permeable embodiment disclosed above such as thin silicone for example.

In the various embodiment disclosed above, closed-bottom mold cells suitably insulated around their sides may be used for promoting directional solidification of the ice therein. And, the closed bottoms prevent water leakage yet are air permeable for releasing the air from the water as it freezes to prevent the formation of cloudy ice, and instead provide clear ice. Directionally solidified clear ice may be readily formed with a simple ice tray grid suitably insulated and air permeable in simple configurations. Clear ice may be produced at the expense of slightly longer freezing times in view of the directional solidification process as opposed to freezing from all exposed sides of the cells.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

What is claimed is:

1. An ice tray comprising a plurality of adjoining mold cells each having an open top and an air permeable closed bottom.

2. An ice tray according to claim 1 further comprising opposite external sides extending vertically between said cell bottoms and tops, and said external sides and cell bottoms being formed of a thermally insulating material.

3. An ice tray according to claim 2 wherein said cell bottoms comprise silicone and are sized in thickness for being air permeable to vent air from water freezing in said cells.

4. An ice tray according to claim 2 wherein said cell bottoms include an aperture extending therethrough, and said aperture is closed by an air permeable seal.

5. An ice tray according to claim 2 further comprising a thermally insulating jacket covering said opposite external sides and cells bottoms.

6. An ice tray according to claim 5 further comprising an air vent disposed between said cell bottoms and said jacket for venting air therefrom.

7. An ice tray according to claim 6 wherein said vent comprises a gap extending outside said jacket.

8. An ice tray according to claim 5 wherein said cells are arranged in a grid, and said jacket completely covers the sides and bottom of said grid, and is fixedly joined thereto.

9. An ice tray according to claim 8 further comprising an air venting gap disposed between said cell bottoms and said jacket and extending outside said jacket for venting air from said gap.

10. An ice tray according to claim 2 further comprising a heater disposed below said cell bottoms.

11. An ice tray according to claim 10 further comprising a thermally insulating jacket covering said opposite external sides of said ice tray.

12. An ice tray according to claim 2 wherein said cells are arranged in a continuous belt including an upper leg having upright cells and a lower leg having inverted cells.

13. An ice tray according to claim 12 further comprising a thermally insulating jacket adjoining opposite external sides of said upper leg for forming respective gaps therebetween.

14. An ice tray according to claim 13 wherein said jacket is disposed along the middle of said upper leg, and terminates short of opposite ends thereof.

15. An ice tray according to claim 14 wherein said jacket further covers the bottom of said upper leg to thermally insulate said cell bottoms.

16. An ice tray according to claim 14 further comprising a heater disposed below said upper leg for locally heating said cell bottoms.

17. A method of using said ice tray according to claim 14 comprising:

filling said cells with water;

circulating freezing air over said water in said cells;

directionally freezing said water in said cells from said tops to bottoms thereof to liberate air therein; and venting said liberated air through said cell bottoms.

18. A method according to claim 17 further comprising rotating said belt ice tray through said jacket to freeze said water in said cells when positioned inside said jacket.

19. A method according to claim 18 wherein said cells are filled with water outside said jacket and transported inside said jacket for freezing therein.

20. An ice tray comprising a plurality of adjoining mold cells arranged in a continuous belt including an upper leg having upright cells and a lower leg having inverted cells, and each of said cells having an open top and an air permeable closed bottom.

21. An ice tray according to claim 20 further comprising a thermally insulating jacket adjoining opposite external sides of said upper leg for forming respective gaps therebetween.

22. An ice tray according to claim 21 wherein said jacket is spaced from one end of said upper leg.

23. An ice tray according to claim 22 wherein said cells comprise silicone.

24. An ice tray according to claim 23 wherein said cell bottoms are thin for being air permeable to vent air released in said cells from freezing water therein.

25. An ice tray according to claim 23 wherein said cell bottoms include an aperture extending therethrough, and said aperture is closed by an air permeable seal.

26. An ice tray according to claim 25 wherein said seal comprises a fabric permeable to air and non-permeable to water leakage.

27. An ice tray according to claim 23 wherein said jacket further covers the bottom of said upper leg to thermally insulate said cell bottoms.

28. An ice tray according to claim 23 further comprising a heater disposed below said upper leg for locally heating said cell bottoms.

* * * * *